US006679391B1

(12) United States Patent
Huang

(10) Patent No.: US 6,679,391 B1
(45) Date of Patent: Jan. 20, 2004

(54) WRENCH SUPPORT RACK ASSEMBLY

(75) Inventor: Steve Huang, Taichung Hsien (TW)

(73) Assignee: Stanley Chiro International Ltd. (TW)

( * ) Notice: Subject to any disclaimer, the term of this patent is extended or adjusted under 35 U.S.C. 154(b) by 0 days.

(21) Appl. No.: 10/231,976

(22) Filed: Aug. 29, 2002

(51) Int. Cl.[7] ..... A47F 7/00
(52) U.S. Cl. ..... 211/70.6; 206/372; 206/376
(58) Field of Search ..... 211/70.6, 89.01, 211/60.1; 206/376, 372

(56) References Cited

U.S. PATENT DOCUMENTS 2,541,597 A * 2/1951 Midling
5,346,063 A * 9/1994 Chow ..... 211/70.6 X
5,598,924 A * 2/1997 McCann ..... 206/372
6,360,892 B1 * 3/2002 Chen ..... 211/70.6 X
6,401,923 B1 * 6/2002 Huang ..... 206/376
2003/0141266 A1 * 7/2003 Lin ..... 211/70.6

OTHER PUBLICATIONS

US 2003/0141266 A1 , Jul. 31, 2003, Lin, 211/70.6.*

* cited by examiner

*Primary Examiner*—Robert W Gibson, Jr.
(74) *Attorney, Agent, or Firm*—Ostrolenk, Faber, Gerb & Soffen, LLP

(57) ABSTRACT

A wrench support rack assembly includes aligned first and second confining members. Each of the confining members defines a groove, and has opposing first and second groove-defining faces confining the groove and spaced apart from each other by a first distance. A pressing member includes an L-shaped first leg disposed proximate to the first confining member, an L-shaped second leg disposed proximate to the second confining member, and a bridging portion interconnecting the first and second legs and having an abutment face spaced apart from a plane which is co-planar with the second groove-defining faces of the first and second confining members by a second distance that is shorter than the first distance.

2 Claims, 7 Drawing Sheets

WRENCH SUPPORT RACK ASSEMBLY

BACKGROUND OF THE INVENTION

1. Field of the Invention

The present invention relates to a wrench support rack assembly, more particularly to a wrench support rack assembly having a pressing member that is adapted to press firmly against the stem of a wrench when the wrench is disposed in the wrench support rack assembly.

2. Description of the Related Art

Referring to FIGS. 1 and 2, a conventional wrench support rack assembly is shown to include a base 1 with left and right sides, and left and right rows of retaining members 2, 2" extending uprightly and respectively from the left and right sides of the base 1. An adjacent pair of the left retaining members 2 cooperatively define a first retaining groove 201. An adjacent pair of the right retaining members 2" cooperatively define a second retaining groove 201 that is aligned with the first retaining groove 201 in a transverse direction relative to the length of the base 1 such that the stem 301 of a wrench 3 can be retained in the first and second retaining grooves 201, as best shown in FIG. 1.

One disadvantage of the aforementioned conventional wrench support rack assembly resides in that the wrench 3 cannot be firmly held in the first and second retaining grooves 201.

SUMMARY OF THE INVENTION

Therefore, the object of this invention is to provide a wrench support rack assembly having a pressing member disposed between two confining members to press the stem of a wrench against the confining members so as to prevent undesired removal of the wrench from the wrench support rack assembly.

Accordingly, a wrench support rack assembly of the present invention includes: a support rack having a base, a first confining member extending uprightly from the base, and a second confining member extending uprightly from the base and aligned with the first confining member in a longitudinal direction. Each of the first and second confining members defines a groove that is adapted to permit extension of a stem of a wrench therethrough, and has opposing first and second groove-defining faces which cooperatively confine the groove and which are spaced from each other by a first distance. A pressing member is disposed between, and is spaced apart from the first and second confining members, and includes an L-shaped first leg that is disposed proximate to the first groove-defining face of the first confining member, that extends uprightly from the base and that has a first section extending in the longitudinal direction, and a second section extending from the first section in a transverse direction relative to the longitudinal direction, an L-shaped second leg that is disposed proximate to the first groove-defining face of the second confining member, that extends uprightly from the base and that has a first section extending in the longitudinal direction, and a second section extending from the first section in the transverse direction, and a bridging portion that interconnects the first sections of the L-shaped first and second legs and that is formed with a protrusion having an abutment face parallel to and spaced apart from a plane which is co-planar with the second groove-defining faces of the first and second confining members by a second distance that is shorter than the first distance such that the abutment face of the bridging portion is adapted to resiliently press the stem of the wrench against the second groove-defining faces of the first and second confining members.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
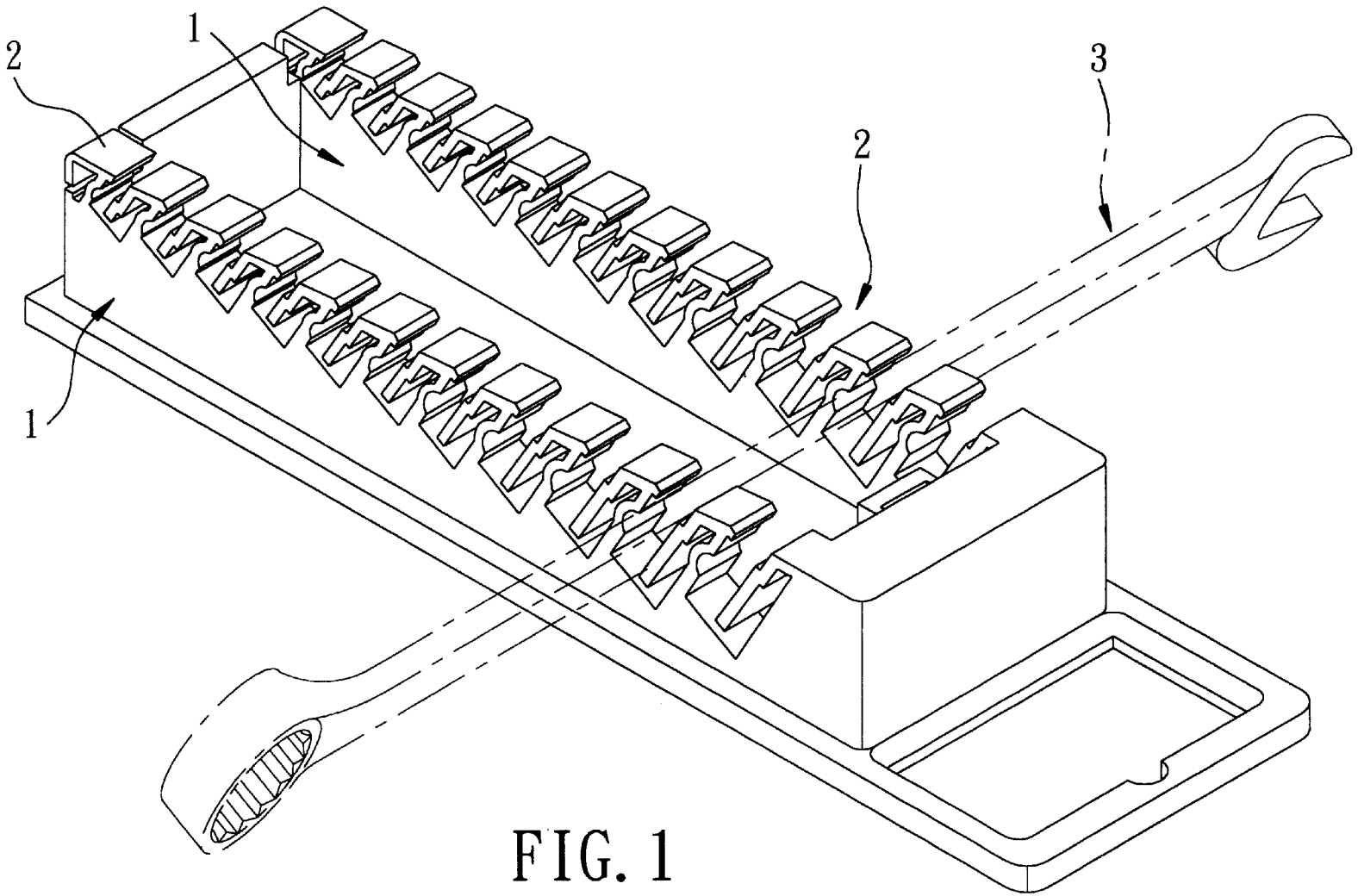
FIG. 1 PRIOR ART
FIG. 1 is a perspective view of a conventional wrench support rack assembly, illustrating how a wrench is retained therein.
Figure 2:
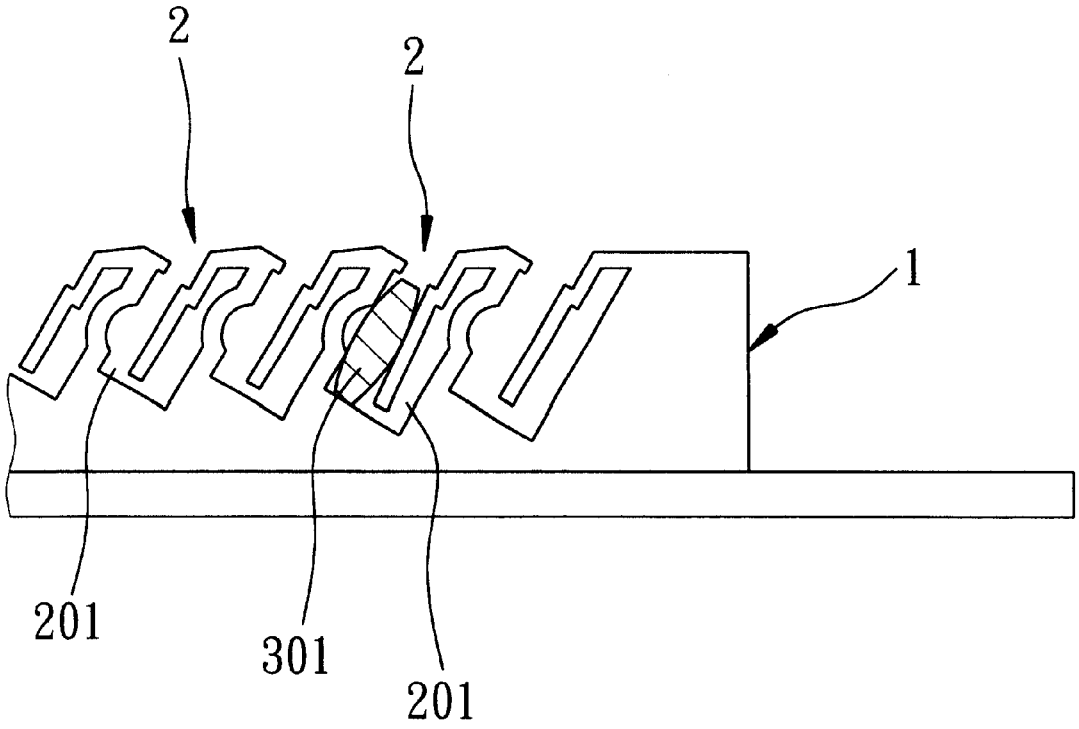
FIG. 2 PRIOR ART
FIG. 2 is a fragmentary side view of the conventional wrench support rack assembly shown in FIG. 1.
Figure 3:
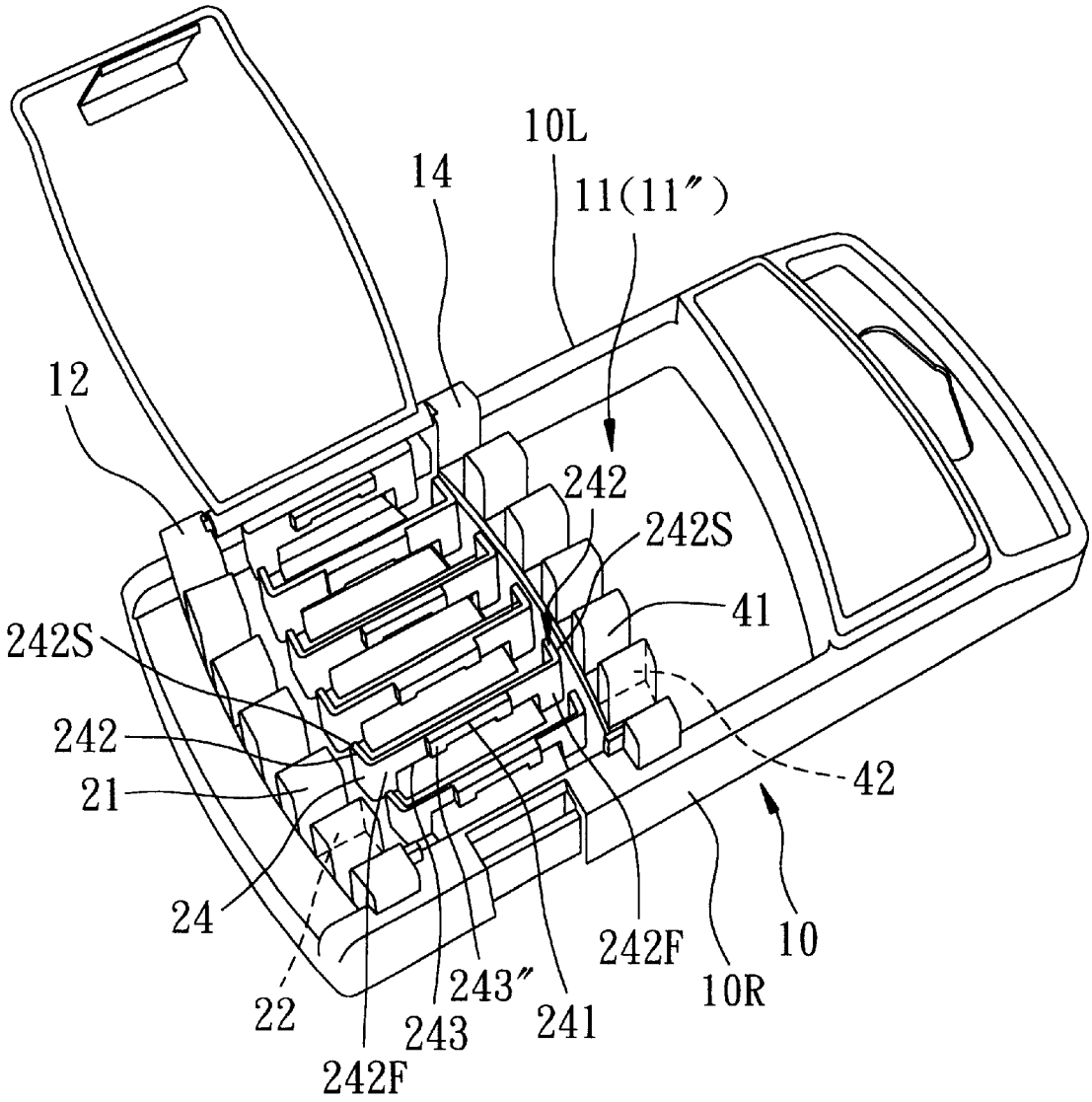
FIG. 3 is a perspective view of a preferred embodiment of a wrench support rack assembly according to the present invention at an uncover position.
Figure 4:
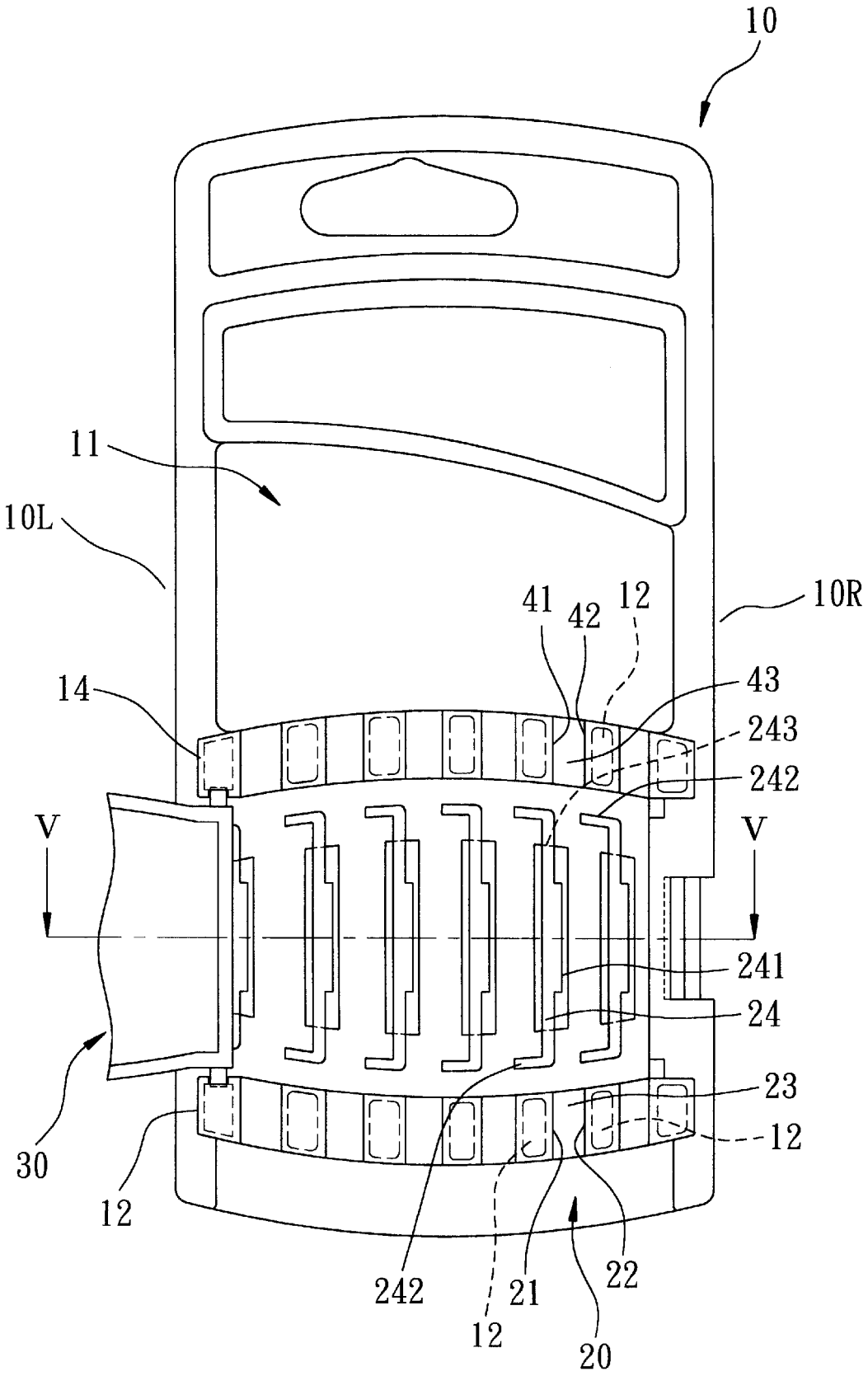
FIG. 4 is a top planar view of the preferred embodiment shown in FIG. 3.
Figure 5:
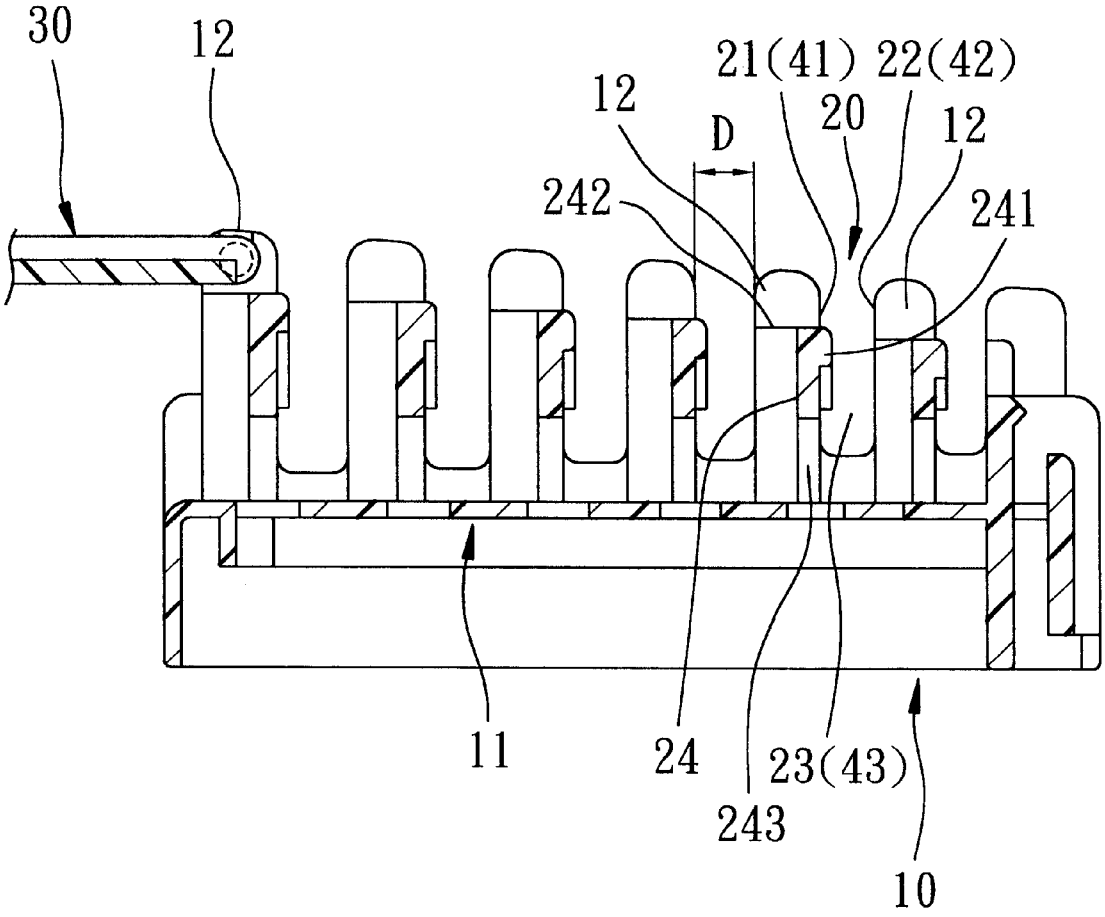
FIG. 5 is a partly sectional view of the preferred embodiment taken along line V—V of FIG. 4.

Referring to FIGS. 3 to 5, the preferred embodiment of a wrench support rack assembly of the present invention is adapted to hold a wrench 100 (see FIG. 6) which has two workpiece-holding ends 112 and a stem 110 interconnecting the workpiece-holding ends 112, and is shown to include a support rack 10, a plurality of pressing members 24, a retention cover 30, and a fastener device 40.

As illustrated, the support rack 10 includes a base 11, a plurality of aligned first confining members 12, and a plurality of aligned second confining members 14. Left and right side plates (10L, 10R) extend respectively and uprightly from two opposites sides of the base 11 to define a receiving space 11" therebetween. The first confining members 12 extend uprightly from the base 11. The second confining members 14 extend uprightly from the base 11, are aligned respectively with the first confining members 12 in a longitudinal direction. Each of the first confining members 12 includes a pair of first poles, and defines a first groove 23 between the first poles, and has a first groove-defining face 21 formed on one of the first poles and a second groove-defining face 22 formed on the other one of the first poles and cooperating with the first groove-defining face 21 to confine the first groove 23. The first and second groove-defining faces 21, 22 are spaced apart from each other by a first distance (D) (see FIG. 5). Each of the second confining members 14 includes a pair of second poles, and defines a second groove 43 between the second poles, and has a first groove-defining face 41 formed on one of the second poles and a second groove-defining face 42 formed on the other one of the second poles and cooperating with the first groove-defining face 41 to confine the second groove 23. The first and second groove-defining faces 41, 42 are spaced apart from each other by a first distance (D) As such, when a wrench 100 is disposed in the wrench support rack assembly of the present invention, the stem 110 of the wrench 100 extends through the first groove 23 of the respective pair of the first confining member 12 and the second groove 43 of Ale respective pair of the second confining members 14 (see FIG. 6).

Figure 6:
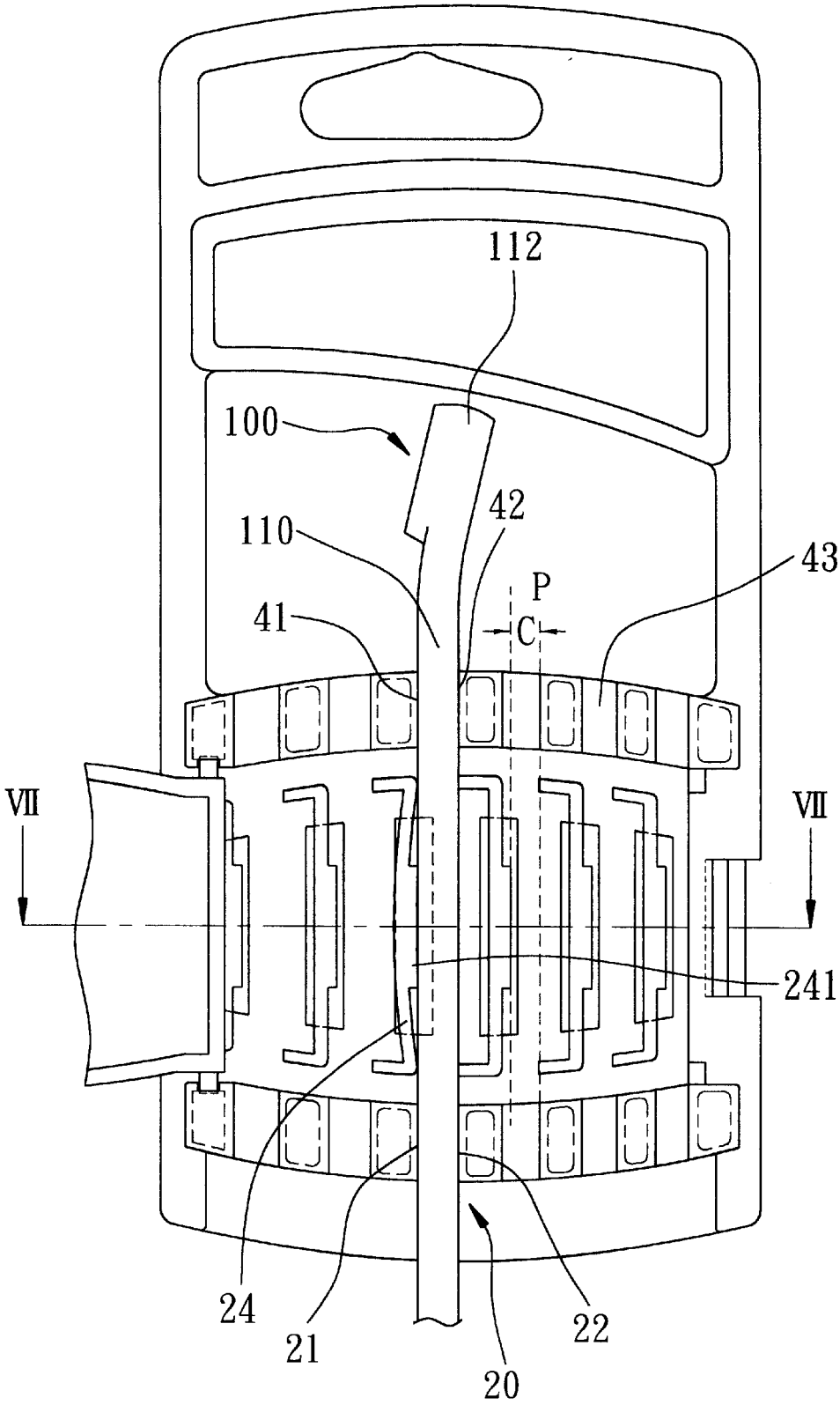
FIG. 6 is a top planer view of the preferred embodiment, illustrating how a pressing member presses against a wrench disposed in the preferred embodiment.
Figure 7:
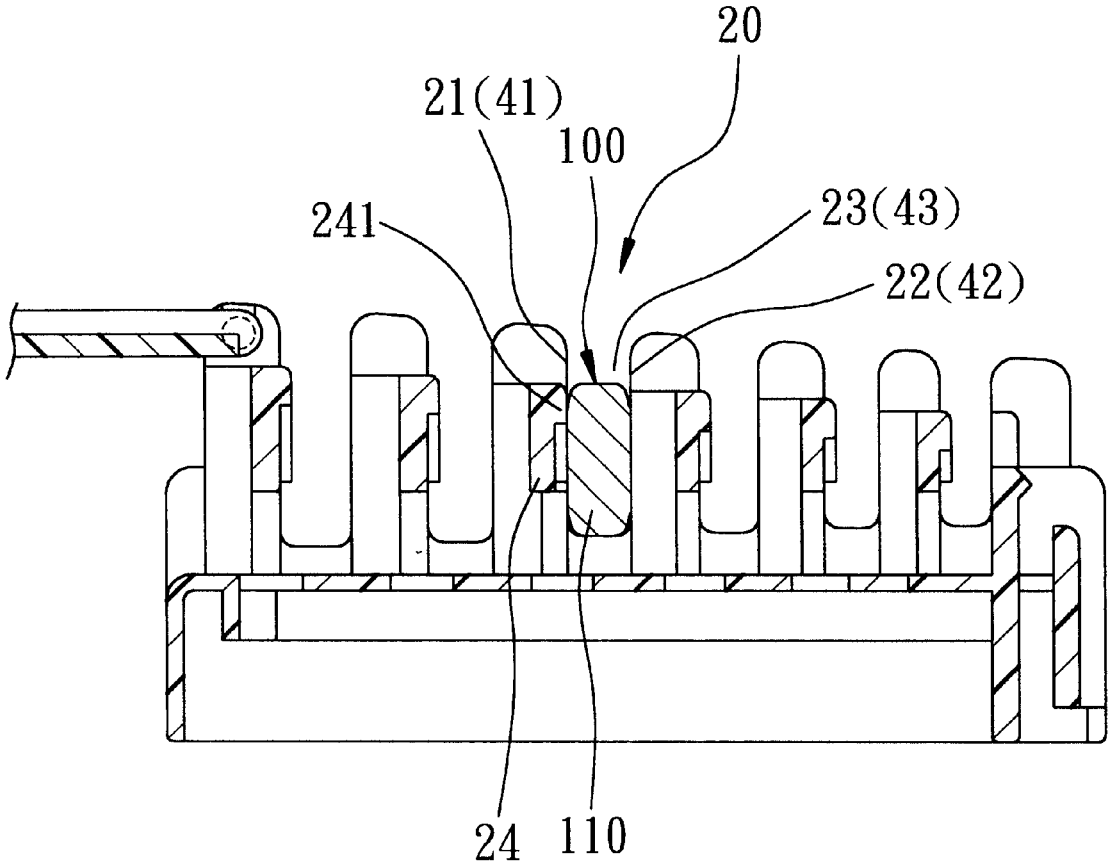
FIG. 7 is a partly sectional view of the preferred embodiment taken along line VII—VII of FIG. 6.

Each of the pressing members 24 is disposed between and is spaced apart from the respective pair of the first confining members 12 and the second confining members 14, and Includes an L-shaped first leg 242, an L-shaped second leg 242, and a bridging portion 243. The first leg 242 is disposed proximate to the first groove-defining face 21 of a respective one the first confining members 12, extends uprightly from the base 11, and has a first section (242F) extending in the longitudinal direction, and a second section (242S) extending from the first section (242F) in a transverse direction relative to the longitudinal direction. The second leg 242 is disposed proximate to the first groove-defining face 41 of a respective one of the second confining members 14, extends uprightly from the base 11, and has a first section (242F) extending in the longitudinal direction, and a second section (242S) extending from the first section (242F) in the transverse direction. The bridging portion 243 interconnects the first sections (242F) of the first and second legs 242, and is formed with a protrusion 243" having an abutment face 241 parallel to and spaced apart from a plane (P) (see FIG. 6) which is co-planar with the second groove-defining faces 22, 42 of the respective pair of the first confining members 12 and the second confining members 14 by a second distance (C) that is shorter than the first distance (D) such that the abutment face 241 of the bridging portion 243 resiliently presses the stem 110 of the wrench 100 against the second groove-defining faces 22, 42 of the respective pair of the first confining members 12 and the second confining members 14 when the wrench 100 is disposed in the respective first and second grooves 23, 43, as best shown in FIGS. 6 and 7, thereby providing a relatively strong biasing action to prevent undesired removal of the wrench 100 from the respective first and second grooves 23, 43.

The bridging member 243 has a bottom spaced apart from the base 11 of the support rack 10 to enhance flexibility of the respective pressing members 24.

With this invention thus explained, it is apparent that numerous modifications and variations can be made without departing from the scope and spirit of this invention. It is therefore intended that the invention be limited only as indicated in the appended claims.

I claim:

1. A wrench support rack assembly for holding a wrench which has two workpiece-holding ends and a stem interconnecting the workpiece-holding ends, said wrench support rack assembly comprising:

a support rack including a base, a plurality of aligned first confining member extending uprightly from said base, and a plurality of aligned second confining member extending uprightly from said base and respectively aligned with said first confining members in a longitudinal direction, an adjacent pair of said first confining members defining a first groove and having opposing first and second groove-defining faces which cooperatively confine said first groove and which are spaced apart from each other by a first distance, an adjacent pair of said second confining members defining a second groove and having opposing first and second groove-defining faces which cooperatively confine said second groove and which are spaced apart from each other by said first distance, said second groove cooperating with said first groove to permit extension of the stem of the wrench therethrough;

a plurality of pressing members disposed respectively between and spaced apart from said first and second confining members, each of said pressing members including an L-shaped first leg that is disposed proximate to said first groove-defining face of a respective one of said first confining members, that extends uprightly from said base, and that has a first section extending in the longitudinal direction, and a second section extending from said first section in a transverse direction relative to the longitudinal direction, an L-shaped second leg that is disposed proximate to said first groove-defining face of a respective one of said second confining members, that extends uprightly from said base, and that has a first section extending in the longitudinal direction, and a second section extending from said first section in the transverse direction, and a bridging portion that interconnects said first sections of said L-shaped first and second legs and that is formed with a protrusion having an abutment face parallel to and spaced apart from a plane which is co-planar with said second groove-defining faces of the respective one of said first and second confining members by a second distance that is shorter than said first distance such that said abutment face of said bridging portion is adapted to resiliently press the stem of the wrench against said second groove-defining faces of the respective one of said first and second confining members.

2. The support rack assembly as defined in claim 1, wherein said bridging member has a bottom spaced apart from said base of said support rack.

* * * * *